United States Patent [19]

Turnipseed

[11] Patent Number: 4,671,230

[45] Date of Patent: Jun. 9, 1987

[54] METHOD AND MEANS FOR CLEANING FUEL INJECTION ENGINES

[76] Inventor: Marion R. Turnipseed, 5916 SE. 5th, Des Moines, Iowa 50315

[21] Appl. No.: 533,301

[22] Filed: Sep. 19, 1983

[51] Int. Cl.[4] ..... F02B 77/04; B08B 3/08

[52] U.S. Cl. ..... 123/198 A; 134/20; 134/23; 134/169 A

[58] Field of Search ..... 123/198 A, 1 A; 134/169 A, 140, 141, 20, 23

[56] References Cited

U.S. PATENT DOCUMENTS

| | | | |
|---|---|---|---|
| 2,201,774 | 5/1940 | Hofele | 123/198 A |
| 2,281,695 | 5/1942 | James et al. | 123/198 A |
| 2,366,073 | 12/1944 | Vallerie | 123/198 A |
| 2,888,913 | 6/1959 | Emmett et al. | 123/198 A |
| 3,148,670 | 9/1964 | Fiedler | 123/198 A |
| 4,059,123 | 11/1977 | Bartos et al. | 134/169 A |
| 4,161,160 | 7/1979 | Hicks et al. | 123/1 A |
| 4,167,193 | 9/1979 | Magnus et al. | 134/169 A |
| 4,331,121 | 5/1982 | Stokes | 123/1 A |
| 4,346,689 | 8/1982 | Neely | 123/1 A |
| 4,516,547 | 5/1985 | Williams | 123/198 A |
| 4,520,773 | 6/1985 | Koslow | 123/198 A |

FOREIGN PATENT DOCUMENTS

| | | | |
|---|---|---|---|
| 1046597 | 12/1953 | France | 123/198 A |
| 2257013 | 9/1975 | France | 123/198 A |
| 652338 | 3/1979 | U.S.S.R. | 123/198 A |

*Primary Examiner*—Ira S. Lazarus

*Attorney, Agent, or Firm*—Zarley, McKee, Thomte, Voorhees & Sease

[57] ABSTRACT

The method of cleaning a fuel injection type internal combustion engine wherein the engine has a block, a combustion chamber, fuel injectors operatively connected to a fuel tank and a fuel pump, an engine starting mechanism and a fuel supply line connecting the fuel tank and the fuel injectors with the fuel pump imposed in the fuel supply line, and a fuel return line connecting the fuel injectors and the fuel tank, wherein the fuel pump is rendered inoperative and the fuel return line is blocked. A combination of fuel and cleaning fluids is imposed under pressure into the fuel supply line. The engine is then started and operated on the supply of fuel and cleaning fluid which have passed through the fuel injectors. After the engine has been operated for a period of time, perhaps 15 minutes or so, the engine is shut off, the fuel return line is unblocked, and the fuel pump is restored to its original condition. The apparatus of cleaning a fuel injection-type fuel combustion engine is disclosed including a pressure tank or container having an inlet port for air under pressure. The tank has a pressure gage and an outlet pipe which leads to a filter mechanism. An outlet pipe from the filter mechanism has a fitting which is adapted to be connected to the fuel supply line of a fuel injection-type internal combustion engine.

10 Claims, 3 Drawing Figures

METHOD AND MEANS FOR CLEANING FUEL INJECTION ENGINES

BACKGROUND OF THE INVENTION

Fuel injection engines of modern vehicles, and particularly the fuel injectors themselves, often become coated with residue, primarily due to their close location to the intake ports of the engine head. Engines in these conditions can have a dead miss at idling speeds. It is often difficult to determine the cause of the malfunction of these engines. For example, a cranking compression test and a cylinder leakage test often will check out satisfactorily. Scoping the engine ignition turns up nothing except to locate the dead cylinder without determining the cause. Prior to the instant invention, it was common to replace the engine injectors when the engine was malfunctioning. This is an expensive undertaking, but has been the conventional remedy since cleaning the injectors has heretofore been difficult, if not impossible.

It is therefore the principal object of this invention to provide a quick and efficient method and means of cleaning the fuel injectors of a fuel injection engine.

A further object of this invention is to provide a method and means of cleaning the fuel injectors of a fuel injection engine which can be easily and quickly used to effect the cleaning operation.

A still further object of this invention is to provide a method and means of cleaning the fuel injectors of a fuel injection engine which is easily adaptable to all fuel injection engines.

These and other objectives will be apparent to those skilled in the art.

BRIEF SUMMARY OF THE INVENTION

This invention involves a method of cleaning a fuel injection-type internal combustion engine. The conventional fuel pump for such an engine is rendered inoperative by disconnecting an electrical fuse or the like. The return fuel line for the engine is disconnected and temporarily blocked. A combination of fuel and cleaning fluid is then imposed under pressure into the fuel injection system of the engine. The engine is then started and allowed to operate for a period of 15 minutes or so with the fuel and cleaning fluids passing through the fuel injectors. The engine is then shut off, the return fuel line is then unblocked and the fuel pump is restored to its operating condition.

The device for cleaning a fuel injection-type internal combustion engine of this invention comprises a pressurized container having an air port and a pressure gage. A fluid line extends from the bottom of the container to a filter means, and a discharge line then extends from the filter means for connection to the intake fuel line of the engine.

DESCRIPTION OF THE PREFERRED EMBODIMENT

Figure 1:
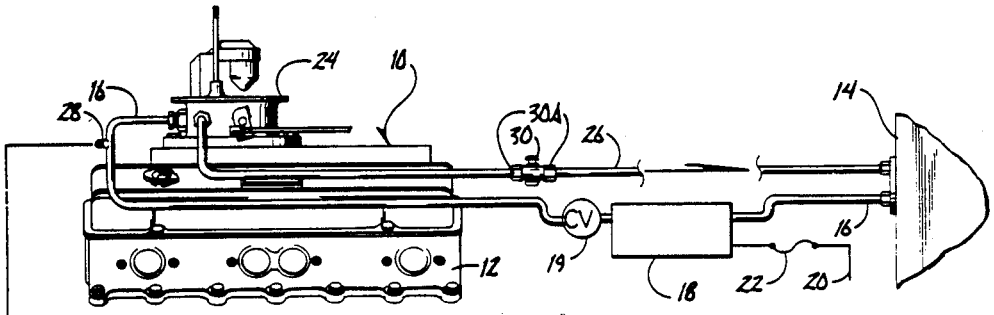
FIG. 1 is a schematic diagram of the device of this invention.
Figure 2:
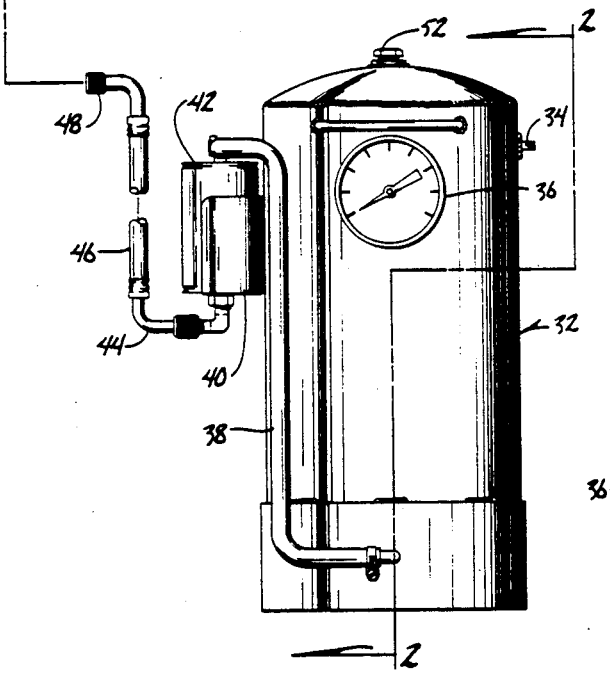
FIG. 2 is a partial sectional view of the apparatus of FIG. 1 as seen on line 2—2 of FIG. 1.
Figure 2:
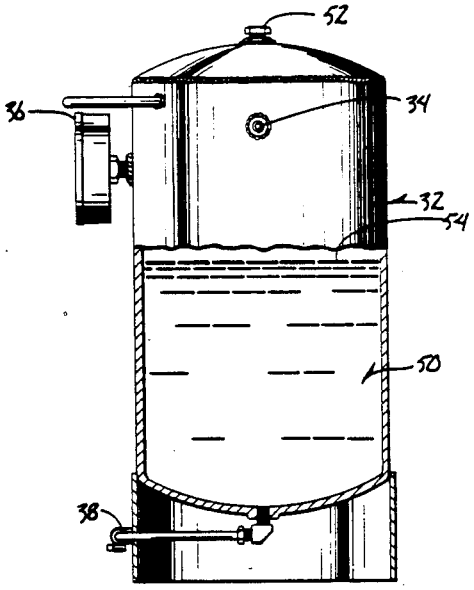
Figure 3:
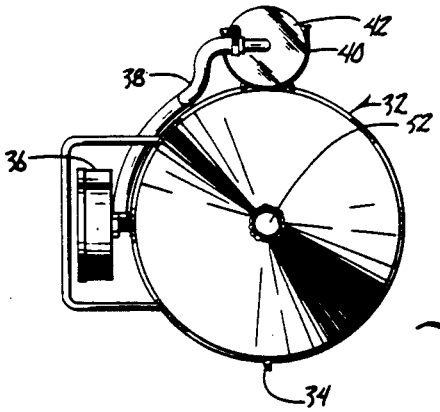
FIG. 3 is a top plan view of the device of FIG. 2.

The numeral 10 designates a conventional fuel injection-type engine which includes a conventional engine block 12. A conventional fuel tank 14 is connected to the engine by fuel supply line 16. A conventional electrical fuel pump 18 is imposed in fuel supply line 16. Fuel pump 18 includes a conventional check valve 19 to prevent fuel in supply line 16 between the fuel pump and the engine from moving back through the fuel pump and into fuel tank 14. Fuel pump 18 includes a conventional power circuit 20 in which conventional fuse 22 is imposed.

Engine 10 includes a conventional fuel injector housing 24 which includes two or more conventional fuel injector nozzles (not shown). A fuel return line 26 extends from housing 24 back to fuel tank 14. A closable fluid inlet port 28 is imposed in fuel supply line 16. A detachable plug 30 is imposed in fuel return line 26 as will be discussed in more detail hereafter.

A closed and sealed flushing container 32 has a normally closed air inlet port 34 located adjacent the top thereof. A conventional pressure gage 36 is mounted on the side of container 32 and is in communication with the interior thereof to conventionally register the internal pressure of the container. An outlet line 38 extends from the inner bottom of container 32 towards filter bracket 40 which in turn supports fluid filter 42. The filter bracket 40 is mounted by any conventional means to the side of the container 32. The construction of filter 42 is conventional and does not of itself a part of this invention.

A fluid outlet line 44 extends from filter 42 and is connected to flexible fluid line 46. Fluid line 46 terminates in connector 48 which is adapted to be secured to fluid inlet port 28 on fluid supply line 16.

A quantity of cleaning solvent 50 and fuel is placed in container 32 through cap 52. Normally, a mixture of equal parts of conventional engine cleaner and gasoline is placed in container 32 to a level 54 wherein the container is only partially filled. An air space dwells above the fluid level 54. Normally, 16 ounces of engine cleaner are mixed with 16 ounces of gasoline. The cap 52 is then securely replaced in position to seal the container 32. The fuel and cleaner 50 should be agitated slightly either before or after being placed in the container to assure that the resulting solution is adequately mixed.

The fuse 22 is then removed from the power circuitry 20 of fuel pump 18 to render the fuel pump inoperative. During the engine cleaning operation, fresh fuel from tank 14 should not be used for it is the purpose of the procedure to utilize the fuel in container 32. The check valve 19 further insures that none of the fluid in container 32 will ever move to the fuel tank 14 through the fuel pump 18.

The connector 48 on the end of flexible fuel line 46 is then secured to the inlet port 28 on inlet fuel line 16. If no service port or inlet port 28 is available on the conventional fuel rail of the vehicle being serviced, a suitable adapter will have to be imposed in the intake fuel line.

Return fuel line 26 is separated by connectors 30A, and plug 30 is inserted therebetween. The purpose of plug 30 is to prevent any excess fuel and solvent from leaving housing 24 and entering fuel tank 14.

An air hose connected to a source of compressed air, not shown, is then attached to air inlet port 34 to provide a quantity of compressed air in the upper portion of container 32 above the cleaning solvent and fuel mixture 50 in the bottom of the container. It is preferred that the pressure within tanks substantially equal the normal operating fuel pressure on the engine being cleaned. This is 12 pounds per square inch on T.B.I. systems and 30 pounds on older E.F.I. systems. The shift lever of the vehicle is placed in park and the emergency brake is set. The engine is therein started through conventional procedures and the idle speed is brought up to about 1500 RPM's. This speed is maintained until the engine dies after all the flushing mixture 50 has been consumed.

The air pressure in the container can then be relieved by opening air inlet port 34. Connector 48 is then removed from inlet port 28. Plug 30 is removed from return fuel line 26 and the return fuel line is reassembled by connections 30A. Fuse 22 is then imposed in power circuit 20 so that the fuel pump 18 can operate.

The purpose of the device of this invention is to decarbonize the induction system as well as the combustion chambers of a fuel injection engine. By passing the flushing solution 50 through the injectors of the engine, any impurities which may cause the injectors to not close tightly, or to hang open, will be flushed out of the system. Carbon buildup on the intake side of the intake valves can cause the engine to idle roughly, or to cause power loss at all speeds. Carbon on valve faces and seats of an engine operated in slow city driving conditions can be cleaned away due to the duration of the flushing process, which is preferably 10 to 15 minutes. When the flushing mixture is injected into the engine, the mixture is sprayed over the throttle plates and the full interior surface of the intake manifold, as well as the intake ports of the head and over the valve systems as it passed into the combustion chambers. The method of this invention should be practiced only on fully warmed up engines as carbon removing solvents are most active at these temperatures.

It is, therefore, seen that this invention provides a quick and efficient method and means of cleaning a fuel injection engine, and this invention therefore achieves at least all of its stated objectives.

I claim:

1. The combination of an injection-type internal combustion engine having an engine block, a combustion chamber in said block, a fuel injection system including a fuel manifold and fuel injectors, a fuel tank, fuel supply return lines extending between said engine and said fuel tank, a fuel pump in said fuel supply line; and a device for cleaning the injection system of said engine, comprising, a closed container having a fluid inlet port, an air valve in the upper portion of said container for introducing air under pressure into said container, a fluid exit port in the lower part of said container for removing fluid from said container, fluid in the lower part of said container comprising a mixture of engine fuel and engine cleaning solvent, means connecting said fluid exit port and said fuel injection system, compressed air in the upper portion of said container in direct contact with said fluid for directly forcing said fluid into said injection system to operate said engine, said fuel pump being disconnected from said fuel injection engine, said closed container being free from connection with said fuel pump and said fuel tank so that only said mixture flows directly from said closed container into said injection system.

2. The device of claim 1 wherein said mixture comprises substantially equal quantities of fuel and cleaning solvent.

3. The combination of claim 1 wherein means is located in said return line to block the flow of fluid therethrough.

4. The combination of claim 1 wherein said device for cleaning the injection system of said engine is connected to said engine only by said means connecting said fluid exit port and said fuel injection system.

5. The method of cleaning a fuel injection system of an injection-type internal combustion engine having an engine block, a combustion chamber in said block, a fuel injection system including a fuel manifold and fuel injectors, a fuel tank, fuel supply and return lines extending between said engine and said fuel tank, and a fuel pump in said fuel supply line, comprising, disconnecting the fuel tank from said fuel injection system by rendering said fuel pump inoperative, partially filling a closed container with a mixture of fuel and cleaning solvent so that an air-filled space exists in said container above said mixture, connecting the portion of said container containing said mixture to said injection system, charging said space in said container with compressed air to impose pressure directly on said mixture substantially equal to the normal operating fuel pressure provided by said fuel pump, to cause said mixture to flow towards said injection system, operating said engine by combusting said mixture to permit said cleaning fluid to clean said injection system as combustion is taking place;

maintaining said closed container free from connection with said fuel pump and said fuel tank so that only said mixture flowing directly from said closed container will pass into said injection system.

6. The method of claim 5 wherein said return line is blocked before said engine is operated.

7. The method of claim 5 wherein said cleaning fluid is comprised of substantially equal parts of fuel and engine cleaning solvent.

8. The method of claim 5 wherein said engine is operated for 10 to 15 minutes.

9. The method of claim 5 wherein said engine is operated to substantially normal operating temperatures to enhance the cleaning ability of said engine cleaning solvent.

10. The method of claim 5 wherein said engine is operated until all of the mixture in said container has passed into said injection system.

* * * * *